US011236746B2

(12) United States Patent
Lo Biundo et al.

(10) Patent No.: US 11,236,746 B2
(45) Date of Patent: Feb. 1, 2022

(54) VARIABLE DISPLACEMENT ROTARY VANE PUMP

(71) Applicant: O.M.P. OFFICINE MAZZOCCO PAGNONI S.R.L., Funo (IT)

(72) Inventors: Giuseppe Lo Biundo, Partinico (IT); Angelo Pancotti, Funo (IT)

(73) Assignee: O.M.P. OFFICINE MAZZOCCO PAGNONI S.R.L., Funo (IT)

( * ) Notice: Subject to any disclaimer, the term of this patent is extended or adjusted under 35 U.S.C. 154(b) by 0 days.

(21) Appl. No.: 16/970,447

(22) PCT Filed: Mar. 6, 2019

(86) PCT No.: PCT/IB2019/051787

§ 371 (c)(1),
(2) Date: Aug. 17, 2020

(87) PCT Pub. No.: WO2019/171281

PCT Pub. Date: Sep. 12, 2019

(65) Prior Publication Data

US 2020/0378382 A1 Dec. 3, 2020

(30) Foreign Application Priority Data

Mar. 7, 2018 (IT) ..... 102018000003344

(51) Int. Cl.
*F04C 14/22* (2006.01)
*F04C 2/34* (2006.01)
(Continued)

(52) U.S. Cl.
CPC ..... *F04C 14/226* (2013.01); *F04C 2/344* (2013.01); *F04C 2240/10* (2013.01); *F04C 2240/30* (2013.01)

(58) Field of Classification Search
CPC ..... F04C 14/22; F04C 14/226; F04C 2/344; F04C 15/0003; F04C 2240/10;
(Continued)

(56) References Cited

U.S. PATENT DOCUMENTS 6,530,752 B2 * 3/2003 Oba ..... F04C 14/226 417/220
8,684,702 B2 * 4/2014 Watanabe ..... F04C 14/223 417/220
(Continued)

FOREIGN PATENT DOCUMENTS

CN 101173660 A 5/2008
CN 104675698 A 6/2015
(Continued)

OTHER PUBLICATIONS

International Search Report and Written Opinion for International PCT Application No. PCT/I B2019/051787 filed on Mar. 6, 2 019 on behalf of O.M.P. Officine Mazzocco Pagnoni S.R.L.. dated May 15, 2019. 8 Pages.
(Continued)

*Primary Examiner* — Audrey B. Walter
*Assistant Examiner* — Dapinder Singh
(74) *Attorney, Agent, or Firm* — Steinfl + Bruno LLP

(57) ABSTRACT

A variable displacement rotary vane pump. The pump has a pump body, a rotor with vanes that rotates inside the pump body around a rotation axis, an oscillating stator arranged in an eccentric position around the rotor, a fulcrum for the rotation of the oscillating stator with respect to the pump body, and adjusting means for adjusting the displacement of the pump. The adjusting means act on the oscillating stator to move it with respect to the rotor and the pump body. The fulcrum is integrally formed with the oscillating stator and is housed in a recess formed in the pump body. The pump
(Continued)

has a sliding element between the fulcrum and the recess. The sliding element is at least partially free to rotate within the recess.

8 Claims, 3 Drawing Sheets

(51) Int. Cl.
*F04C 15/00* (2006.01)
*F04C 2/344* (2006.01)

(58) Field of Classification Search
CPC ..... F04C 2240/30; F04C 2240/50; F04C 2240/56; F04C 28/22
See application file for complete search history.

(56) References Cited

U.S. PATENT DOCUMENTS

2008/0247894 A1 10/2008 Lutoslawski et al.
2008/0308062 A1 12/2008 Morita et al.
2013/0164163 A1* 6/2013 Ohnishi ..... F04C 2/344 418/27
2015/0020759 A1* 1/2015 Watanabe ..... F01L 1/3442 123/90.15
2015/0322944 A1* 11/2015 Calderoni ..... F04C 15/0088 418/1
2017/0167484 A1 6/2017 Peters et al.

FOREIGN PATENT DOCUMENTS

DE 102013021187 A1 6/2015
DE 102015223452 A1 6/2017

OTHER PUBLICATIONS

First Chinese Office Action for CN Application No. 201980016932.6 filed on Mar. 6, 2019 on behalf of O.M.P. Officine Mazzocco Pagnoni S.R.L. dated Sep. 27, 2021. 11 Pages.

* cited by examiner

VARIABLE DISPLACEMENT ROTARY VANE PUMP

CROSS-REFERENCE TO RELATED APPLICATIONS

The present application is the U.S. National Stage of International Patent Application No. PCT/IB2019/051787 filed on Mar. 6, 2019 which, in turn, claims priority to Italian Patent Application No. 102018000003344 filed on Mar. 7, 2018.

The present invention relates to a variable displacement rotary vane pump.

Preferably, the pump of the invention is used in the automotive sector, in particular as an oil pump in internal combustion engines for motor vehicles. The pump of the invention can also be used as a water pump in the engine cooling circuits of internal combustion engines or as a fuel pump in the supply circuits of the aforementioned engines.

In the following description, reference will be made in particular to the use of the pump of the invention as an oil pump in a petrol or diesel internal combustion engine of a motor vehicle, it being understood that what is described more generally also applies to different types of internal combustion engines and to other types of vehicles.

Figure 1:
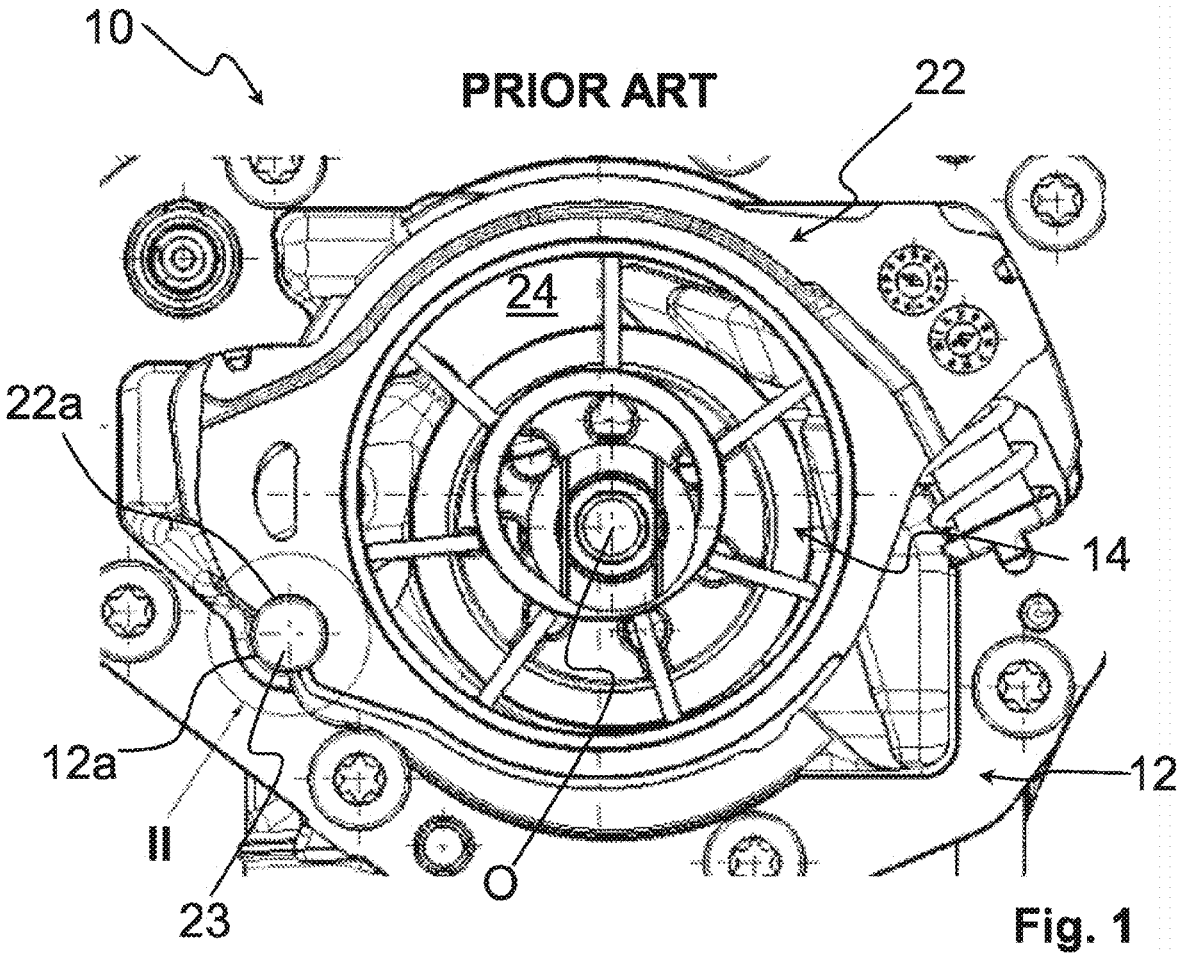
Figure 2:
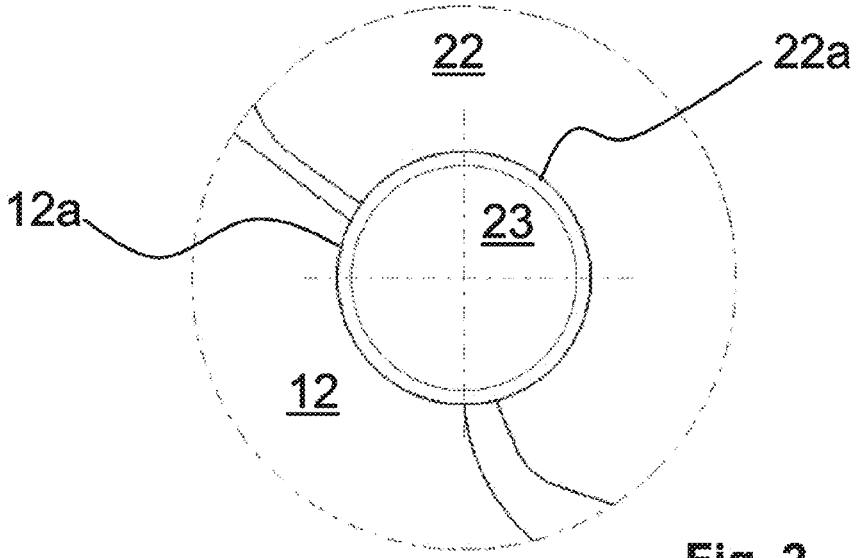
Fig. 2 PRIOR ART

FIGS. 1 and 2 show a variable displacement oil pump of the prior art, indicated as a whole with number 10. The pump 10 comprises a pump body 12, a rotor 14 which can rotate inside the pump body 12 around a rotation axis O and an oscillating stator 22 arranged in an eccentric position around the rotor 14 and movable inside the pump body 12 around an oscillating pin (or fulcrum) 23. FIG. 2 shows an enlargement of a portion of the pump 10 at the oscillating pin 23.

The oscillating pin 23 is an element distinct from the pump body 12 and from the oscillating stator 22 and is housed in part in a recess 12*a* formed on an inner surface of the pump body 12 and in part in a recess 22*a* formed on the oscillating stator 22.

The pump body 12 and the oscillating pin 23 are made of a metallic material (for example aluminium and steel, respectively), while the oscillating stator 22 can be made of a non-metallic material (for example carbon graphite or plastic).

The Applicant has found that, in the pump of the type described above, the area of the oscillating stator 22 at the recess 22*a* is subjected to high mechanical stress. Due to this high mechanical stress, the friction generated between the oscillating pin 23 and the oscillating stator 22, and/or the wear of the aforementioned components, is high. This reduces the efficiency and reliability of the pump.

The Applicant has also found that such a high friction is generated at an area of the oscillating stator 22 where, due to the provision of the aforementioned recess 22*a*, there is a reduction in the resistant section of the oscillating stator 22. This reduction in the resistant section causes a structural weakening of the oscillating stator 22 precisely in the area where it would instead be appropriate to provide for a high structural resistance in order to adequately counter the high stresses provided therein.

DE 10 2015 223452 discloses a pump according to the preamble of claim 1.

The technical problem underlying the present invention is to overcome the drawbacks discussed above.

The present invention therefore relates to a variable displacement rotary vane pump according to claim 1.

This pump comprises a pump body, a rotor which can rotate inside the pump body around a rotation axis and provided with a plurality of vanes, an oscillating stator arranged in an eccentric position around the rotor, a fulcrum for the rotation of said oscillating stator with respect to the pump body, and adjusting means for adjusting the displacement of the pump, sad adjusting means acting on the oscillating stator to move it with respect to the rotor and the pump body. The fulcrum is made in a single piece with said oscillating stator and is housed in a recess formed in said pump body. This pump comprises a sliding element interposed between said fulcrum and said recess.

In the following description and in the subsequent claims the expression "sliding element" is used to indicate both an element that is able to reduce the friction between two components compared to the case wherein this sliding element is not provided between the same components, and an element made of a material which is more resistant to wear than that of the aforementioned two components.

Advantageously, thanks to the provision of the fulcrum integrated in the oscillating stator there are no problems of friction between the fulcrum and the oscillating stator and, thanks to the provision of the aforementioned sliding element, the friction between the fulcrum and the pump body and/or their wear is considerably reduced. In conclusion, in the pump of the invention the effects caused by the friction resulting from the rotation of the oscillating stator with respect to the pump body are considerably reduced with respect to the pump of the prior art described above, with an increase of the efficiency and reliability of the pump.

The fulcrum is therefore made of the same material as the oscillating stator.

The fulcrum defines in the oscillating stator an area with an increased resistant section, thus increasing the structural resistance of the oscillating stator. The mounting and maintenance operations of the pump are facilitated, as the fulcrum is not a separate element from the oscillating stator.

The stresses which the oscillating stator is subjected to at the fulcrum are reduced, as part of these stresses are in fact discharged and supported by the sliding element.

The sliding element structurally decouples the fulcrum from the recess during the rotation of the first with respect to the second, bears part of the stresses discharged by the fulcrum on the recess, distributing them on a surface which can be selected as wider or less wide depending on the expected or measured load. Sliding elements of different sizes and materials can be provided in order to use the one which is considered most suitable or to eventually replace the one that was initially used with another one that is considered more suitable upon measurements or tests, or in case of maintenance.

Preferred features of the pump of the invention are recited in the dependent claims. The features of each dependent claim can be used individually or in combination with those recited in the other dependent claims, except when they are in evident contrast with each other.

In the pump of the invention, said sliding element is at least partially free to rotate within said recess. The friction generated by the load that the fulcrum exerts on the pump body is in this case further reduced due to the fact that part of this load causes the rotation of the sliding element in the recess.

Preferably, said sliding element comprises opposite curved end portions configured to selectively abut against said pump body or against said oscillating stator when the oscillating stator moves between a position of maximum eccentricity and a position of minimum eccentricity of said oscillating stator with respect to the rotor. The aforementioned curved end portions limit the relative rotation of the sliding element to predetermined angles with respect to the pump body or to the oscillating stator and prevent the sliding element from going out of the recess.

The sliding element could however be housed in the recess so as to be integral with the pump body. In this case it is preferable that the sliding element is made of a material having a friction coefficient lower than that of the material which the pump body is made with or of a material more resistant to wear than the material used to make the pump body.

Preferably, said sliding element is at least partially free to rotate with respect to said fulcrum. In this case, the friction with the pump body caused by the load on the fulcrum is further reduced due to the fact that part of the load exerted by the fulcrum on the pump body causes the rotation of the sliding element with respect to the fulcrum.

In an alternative embodiment of the pump of the invention, the sliding element is integrally coupled to said fulcrum. In this case, it is preferable that the sliding element is made of a material different than that of the oscillating stator, in particular a material having a friction coefficient lower than that of the oscillating stator, so as to be able to achieve a reduction of friction between the fulcrum and pump body with respect to the case wherein no sliding element is used. As an alternative, the sliding element can be made of a material which is more resistant to wear than that of the oscillating stator, so as to achieve a reduction of wear between the fulcrum and the pump body compared to the case wherein no sliding element is used.

In the aforementioned alternative embodiment, said sliding element preferably comprises opposite curved end portions, each one inserted in a respective recess formed in said fulcrum or in the oscillating stator.

As an alternative to the provision of the aforementioned curved end portions, the stable coupling between the sliding element and the fulcrum can be achieved by making the sliding element in an elastic material, so as to allow the sliding element to elastically deform when it is coupled to the fulcrum and to exert a compression force on the fulcrum after the aforementioned elastic deformation.

Preferably, said sliding element is made of a metallic material, preferably steel or alloys thereof.

Advantageously, in the case wherein the sliding element is integral with the fulcrum, the rotation between the sliding element and the recess formed in the pump body is carried out under conditions of reduced friction or less wear.

Preferably, said sliding element has a shape that matches at least in part the shape of said fulcrum and the shape of said recess, so as to obtain the desired relative rotation between the oscillating stator and the pump body.

Preferably, said pump body is made of a metallic material, in particular of aluminium or alloys thereof, or of steel or alloys thereof.

Said oscillating stator can be made of a metallic material, in particular aluminium or alloys thereof, or in steel or alloys thereof. In this case the oscillating stator can be obtained by die casting.

Preferably, the oscillating stator is made of a non-metallic material, in particular of carbon graphite or plastic, or thermoplastic or thermosetting material, with or without fillers or additives. In this case the oscillating stator can be obtained by moulding.

Figure 3:
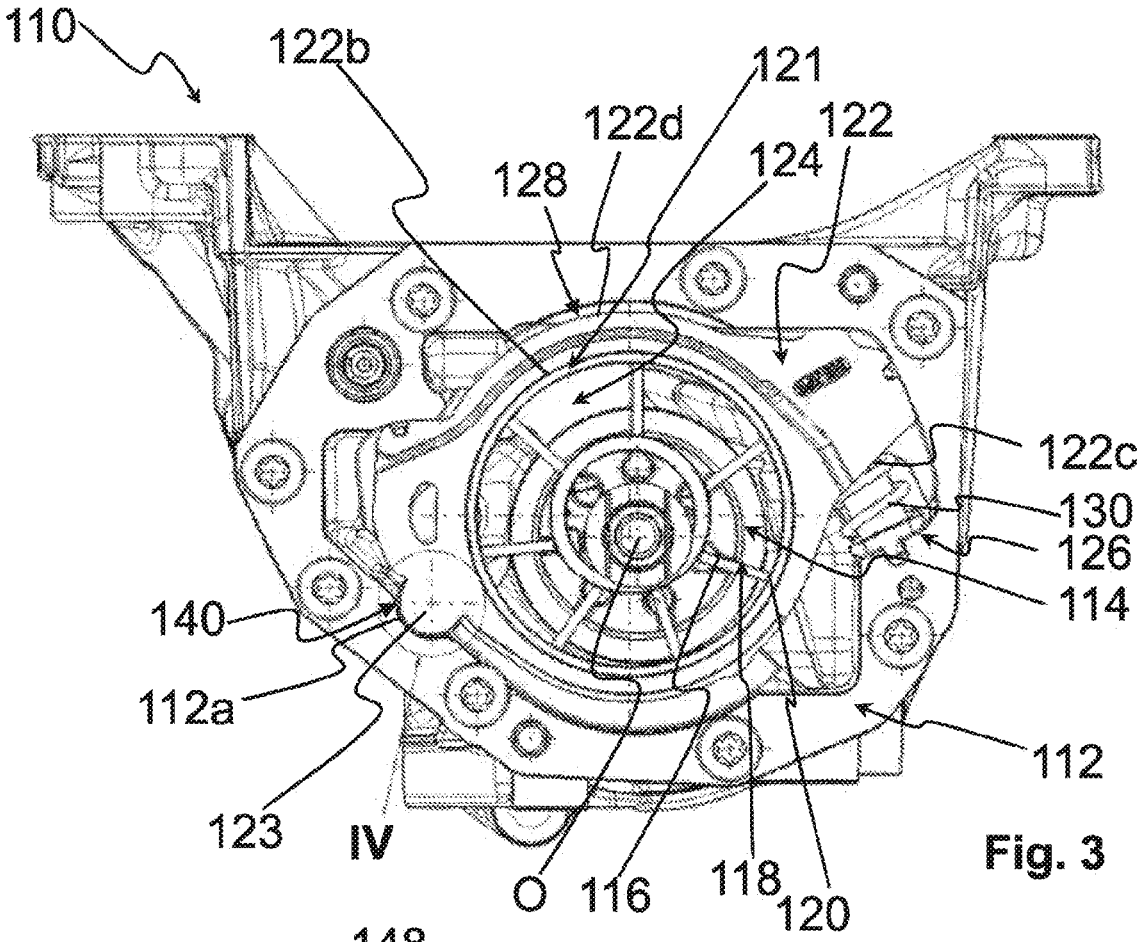
Figure 4:
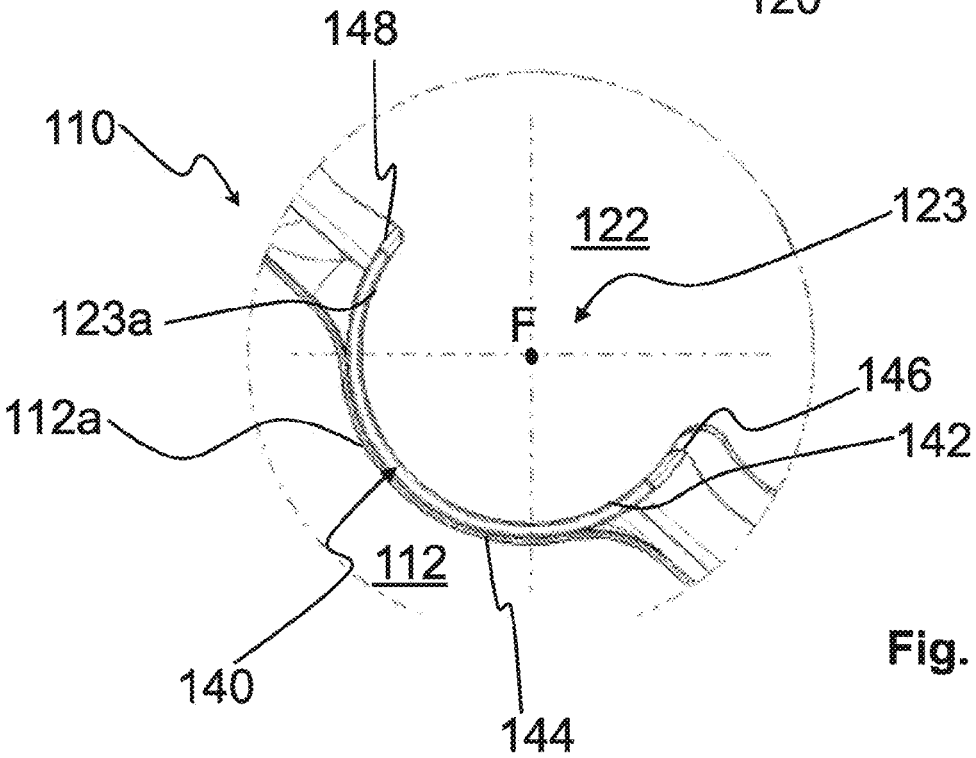
Figure 5:
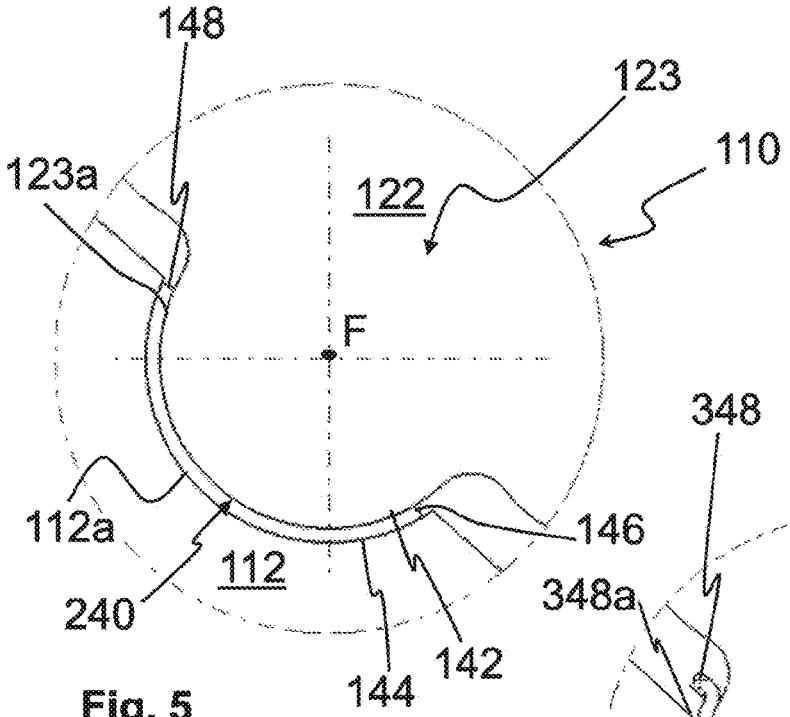
Figure 6:
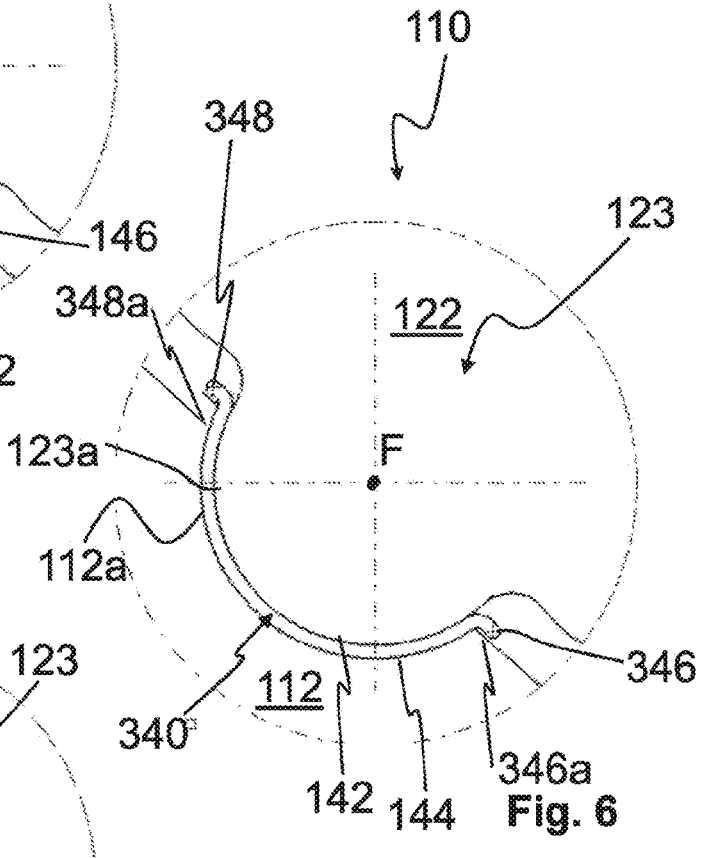
Figure 7:
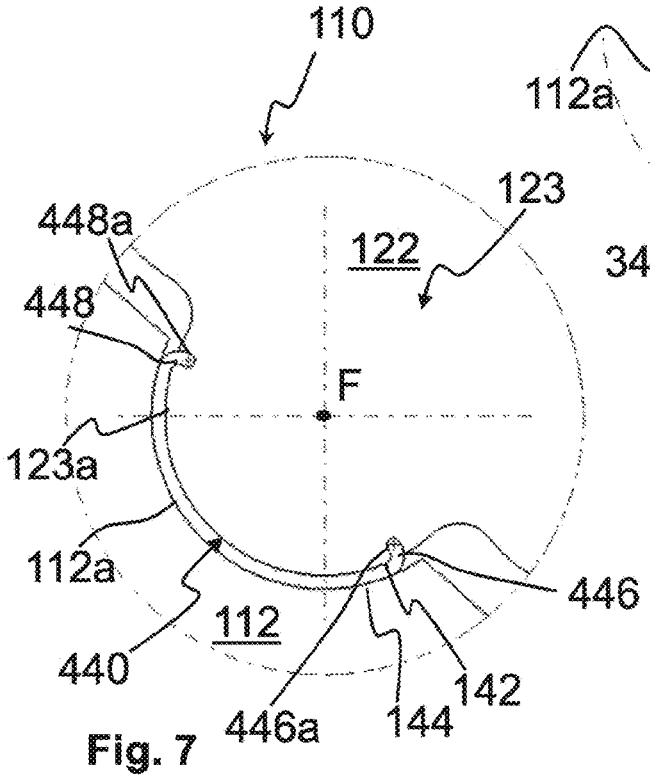

Further characteristics and advantages of the present invention will become clearer from the following detailed description of preferred embodiments thereof, made with reference to the appended drawings and provided by way of indicative and non-limiting example. In such drawings:

FIG. 1 schematically shows a cross-section of a variable displacement oil pump made according to the prior art described above;

FIG. 2 schematically shows a portion of the pump of FIG. 1 in an enlarged scale, in particular of the portion II circled in FIG. 1;

FIG. 3 schematically shows a cross-section of a first embodiment of a variable displacement oil pump made according to the invention;

FIG. 4 schematically shows a portion of the pump of FIG. 3 in an enlarged scale, in particular of the portion IV circled in FIG. 3;

FIGS. 5-7 schematically show cross-sections of a portion (analogous to that of FIG. 4) of three further embodiments of a variable displacement oil pump made according to the invention.

With initial reference to FIGS. 3 and 4, a first embodiment of a variable displacement rotary vane pump (in particular a variable displacement oil pump) according to the present invention is shown. This pump is indicated with number 110.

The pump 110 comprises a pump body 112 inside which a rotor 114 rotates. The rotor 114 is provided with radial cavities 116 inside which vanes 118 slide. For the sake of illustrative clarity, the reference numbers 116 and 118 are associated with only one of the radial cavities and only one of the vanes which are illustrated.

The rotor 114 can rotate inside the pump body 112 around a rotation axis O.

An oscillating stator 122 is arranged in an eccentric position around the rotor 114. The oscillating stator 122 can be moved inside the pump body 112 around a fulcrum 123.

The radially outer end portions 120 of the vanes 118 contact a ring 121 interposed between the rotor 114 and the oscillating stator 122. The ring 121 is in contact with a radially inner surface 122*b* of the oscillating stator 122.

The vanes 118, the ring 121 and the rotor 114 define a plurality of chambers 124 inside the pump body 112 (for the sake of illustrative clarity, the reference number 124 is associated with only one of the chambers which are illustrated). Oil is fed into the chambers 124. The oil is put under pressure due to the effect of the decrease of volume in the chambers 124 upon rotating the rotor 114. The oil under pressure is then fed to the parts of the engine that need to be lubricated.

The capacity or displacement of the pump 110 is determined by the eccentricity between the centre of the oscillating stator 122 and the rotation axis O of the rotor 114. Therefore, a variation of the aforementioned eccentricity causes a variation in the flow rate or displacement of the pump.

In order to move the oscillating stator 122 with respect to the rotor 114 and the pump body 112, adjusting means 126 act on the oscillating stator 122 for adjusting the eccentricity between the oscillating stator 122 and the rotor 114, that is, adjusting means 126 are configured for adjusting the flow rate or displacement of the pump 110.

In the non-limiting example shown in FIG. 3, the eccentricity between the rotor 114 and the oscillating stator 122 is determined by the equilibrium between the thrust action exerted on the oscillating stator 122 by a fluid (typically oil) fed under pressure inside a thrust chamber 128 defined between the pump body 112 and the oscillating stator 122, the thrust action exerted on the oscillating stator 122 by a helical spring 130 and the forces exerted on the oscillating stator 122 by the oil under pressure which is inside the oscillating stator 122 (hereinafter referred to as "internal forces").

The helical spring 130, of the compression type, is associated at a first free end thereof with the pump body 112 and thrusts at the opposite free end thereof on a first outer surface portion 122*c* of the oscillating stator 122 arranged on the side opposite of the fulcrum 123 with respect to the rotor 114. The thrust chamber 128 is defined between the pump body 112 and a second outer surface portion 122*d* of the oscillating stator 122.

The eccentricity between the rotation axis O of the rotor 114 and the centre of the oscillating stator 122 is therefore determined by the equilibrium between the thrust action exerted by the helical spring 130 on the first outer surface portion 122*c* of the oscillating stator 122, the opposite thrust action exerted on the second outer surface portion 122*d* of the oscillating stator 122 by a predetermined amount of fluid (typically oil) fed under pressure into the thrust chamber 128 and the aforementioned internal forces.

The helical spring 130 and the thrust chamber 128, when filled with pressurized fluid, define the aforementioned adjusting means 126.

In a variant, the ring 121 can be omitted. In this case, the radially outer end portions 120 of the vanes 118 contact the radially inner surface 122*b* of the oscillating stator 122 and the vanes 118, the oscillating stator 122 and the rotor 114 define the plurality of chambers 124 inside the pump body 112.

The oscillating stator 122 is pivoted inside the pump body 112 at the fulcrum 123 and is movable with respect to the rotor 114 between a first position wherein the eccentricity between the rotation axis O of the rotor 114 and the centre of the oscillating stator 122 is minimum and a second position wherein the eccentricity between the rotation axis O of the rotor 114 and the centre of the oscillating stator 122 is maximum (FIG. 3 illustrates a condition near or corresponding to that of maximum eccentricity).

The fulcrum 123 is made in one piece with the oscillating stator 122 and is housed in a recess 112*a* formed in the pump body 112.

The fulcrum 123 comprises an outer wall 123*a* which has in a part thereof a substantially cylindrical shape.

A rotation axis F is defined in the fulcrum 123, and the oscillating stator 122 rotates with respect to the rotation axis F.

The pump 110 also comprises a sliding element 140 which is interposed between the fulcrum 123 and the recess 112*a* of the pump body 112.

The sliding element 140 has a shape that matches at least partially the shape of the fulcrum 123 and the recess 112*a*, so as to allow the relative rotation between the oscillating stator 122 and the pump body 112, between a position of maximum eccentricity and a position of minimum eccentricity of the oscillating stator 122 with respect to the rotor 114.

In particular, the recess 112*a* comprises a substantially cylindrical surface, on which the sliding element 140 is arranged.

The sliding element 140 extends along an arc of circumference and has a substantially uniform radial thickness.

The sliding element 140 comprises a radially inner wall 142, facing the outer wall 123*a* of the fulcrum 123, and a radially outer wall 144, facing the recess 112*a* of the pump body 112.

The radially inner wall 142 and the radially outer wall 144 have a substantially cylindrical shape.

In the non-limiting example shown in FIG. 4, the overall circumferential extension of the sliding element 140 is greater than the overall circumferential extension of the recess 112*a*. In particular, one or two end portions 146, 148 of the sliding element 140 protrude from the recess 112*a* (from only one part of the recess 112*a* or from both opposite parts of the recess 112*a*, as in FIG. 4), continuing to at least partially wrap the outer wall 123*a* of the fulcrum 123.

The sliding element 140 is at least partially free to rotate in the recess 112*a*. In particular, the sliding element 140 partly follows the rotation (clockwise and counter-clockwise) of the fulcrum 123, sliding in the recess 112*a*.

The sliding element 140 is also at least partially free to rotate with respect to the fulcrum 123.

In operation, when the fulcrum 123 of the oscillating rotor 122 rotates with respect to the pump body 112 at a given angle, the sliding element 140 rotates in the same direction as the fulcrum 123, but at a smaller angle, which depends on the frictional forces between the fulcrum 123 and the sliding element 140 and by the frictional forces between the sliding element 140 and the recess 112*a*.

The aforementioned frictional forces also depend on the materials which the above components are made with.

The pump body 112 is preferably made of a metallic material, in particular of aluminium or alloys thereof, or of steel or alloys thereof.

The oscillating stator 122 is preferably made of a non-metallic material, in particular of carbon graphite or plastic, or thermoplastic or thermosetting, with or without fillers or additives.

The sliding element 140 is preferably made of a metallic material, more preferably made of steel or alloys thereof.

As an alternative, the oscillating stator 122 can be made of a metallic material, in particular aluminium or alloys thereof, or in steel or alloys thereof.

In a variant of the invention, the sliding element 140 can be housed in the recess 112*a* so as to be integral with the pump body 112. In this case it is preferable that the sliding element 140 is made of a material having a friction coefficient lower than that of the material which the pump body 112 is made with. For example, the sliding element 140 can be made of a self-lubricating material.

FIG. 5 shows a portion of a second embodiment of a variable displacement rotary vane pump 110 (in particular a variable displacement oil pump) according to the present invention.

This pump substantially differs from the pump 110 of FIGS. 3 and 4 in the sliding element, indicated with number 240. In particular, the sliding element 240 substantially differs from the sliding element 140 of FIG. 4 in that it has an overall circumferential extension smaller than that of the sliding element 140, in particular smaller than the overall circumferential extension of the recess 112*a*.

The sliding element 240 can also have an overall circumferential extension which is substantially equal to that of the recess 112*a*, i.e. smaller than that illustrated in FIG. 5. The important aspect is that the sliding element 240 supports the rotation of the oscillating stator 122 in all the angular positions thereof defined between the position of maximum eccentricity and the position of minimum eccentricity of the oscillating stator 122.

If the sliding element 240 has an overall circumferential extension equal to or smaller than that of the recess 112*a*, the opposite end portions 146, 148 of the sliding element 240 should preferably be rounded, or at least without sharp edges, to avoid damaging the recess 112*a* or the fulcrum 123.

FIG. 6 shows a portion of a third embodiment of a variable displacement rotary vane pump 110 (in particular a variable displacement oil pump) according to the present invention.

This pump substantially differs from the pump 110 of FIGS. 3 and 4 in the sliding element, indicated with number 340.

In particular, the sliding element 340 substantially differs from the sliding element 140 of FIG. 4 because the end portions 346, 348 of the sliding element 340 are curved on opposite sides, going away from the rotation axis F of the fulcrum 123.

The aforementioned end portions 346, 348 are configured to selectively abut against the pump body 112 or against the oscillating stator 122 during the movement of the latter between a position of maximum eccentricity and a position of minimum eccentricity of the oscillating stator 122 with respect to the rotor 114. In particular, in the specific example illustrated herein, the end portions 346, 348 selectively abut against the portions 346*a*, 348*a* of the pump body 112 located near the recess 112*a*. The aforementioned end portions 346, 348 therefore limit the relative rotation of the sliding element 340 with respect to the pump body 112 and prevent the sliding element 340 from protruding out of the recess 112*a*.

FIG. 7 shows a portion of a fourth embodiment of a variable displacement rotary vane pump 110 (in particular a variable displacement oil pump) according to the present invention.

This pump substantially differs from the pump 110 of FIGS. 3 and 4 in the sliding element, indicated with number 440.

In particular, the sliding element 440 substantially differs from the sliding element 140 of FIG. 4 because the sliding element 440 is integrally coupled to the fulcrum 123.

For this purpose, the end portions 446, 448 of the sliding element 440 are curved towards each other, i.e. approaching the rotation axis F of the fulcrum 123.

The end portions 446, 448 are inserted in respective recesses 446*a*, 448*a* formed in the fulcrum 123.

In an alternative embodiment not shown, the sliding element 440 has a shape identical to that of the sliding element 140 of FIG. 4 or to that of the sliding element 240 of FIG. 5 and is made of an elastic material so as to allow the sliding element 440 to elastically deform when it is coupled to the fulcrum 123 and to exert a compression force on the fulcrum 123 upon deformation of the aforementioned elastic.

The sliding element 440 can be made of a material having a friction coefficient lower than that of the oscillating stator 122, so as to be able to achieve a reduction of friction between the fulcrum 123 and the pump body 112 with respect to the case wherein no sliding element 440 is used.

In particular, in the case of an oscillating stator 122 made of a non-metallic material (in particular in carbon graphite or plastic, or thermoplastic or thermosetting material, with or without fillers or additives) and a pump body 112 made of a metallic material (in particular in aluminium or alloys thereof, or in steel or alloys thereof), the sliding element 140 is preferably made of a metallic material (for example steel or alloys thereof), so that the rotation between the sliding element 440 and the recess 112*a* formed in the pump body 112 is carried out under conditions of reduced friction or less wear.

In all the embodiments described above, the sliding element 140, 240, 340, 440 can be made of a material which is more resistant to wear than that of the pump body 112 and/or of the oscillating stator 122. In this case the material which the sliding element 140, 240, 340, 440 is made with can also have a friction coefficient equal to or greater than that of the pump body 112 and/or of the oscillating stator 122.

In order to satisfy specific and contingent requirements, a person skilled in the art will be able to make numerous modifications and variations to the variable displacement rotary vane pump described above with reference to FIGS. 3-7, all of which are within in the scope of protection of the present invention as defined by the following claims.

The invention claimed is:

1. A variable displacement rotary vane pump, comprising
a pump body,
a rotor configured to rotate inside the pump body around a rotation axis and provided with a plurality of vanes,
an oscillating stator arranged in an eccentric position around the rotor,
a fulcrum for the rotation of said oscillating stator with respect to the pump body, and
adjusting means configured to adjust the displacement of the pump, the adjusting means acting on the oscillating stator to move the oscillating stator with respect to the rotor and the pump body,
wherein
said fulcrum is made in a single piece with said oscillating stator and is housed in a recess formed in said pump body,
the pump comprises a sliding element interposed between said fulcrum and said recess, and
said sliding element is at least partially free to rotate within said recess.

2. The variable displacement rotary vane pump of claim 1, wherein said sliding element comprises opposed curved end portions configured to selectively abut against said pump body or said oscillating stator when said oscillating stator moves between a position of maximum eccentricity and a position of minimum eccentricity of said oscillating stator with respect to the rotor.

3. The variable displacement rotary vane pump of claim 1, wherein said sliding element is at least partially free to rotate with respect to said fulcrum.

4. The variable displacement rotary vane pump of claim 1, wherein said sliding element is integrally coupled to said fulcrum or to said oscillating stator (122).

5. The variable displacement rotary vane pump of claim 1, wherein said sliding element is made of a metallic material.

6. The variable displacement rotary vane pump of claim 1, wherein said sliding element has a shape that matches at least in part a shape of said fulcrum and a shape of said recess.

7. The variable displacement rotary vane pump of claim 1, wherein said pump body is made of a metallic material.

8. The variable displacement rotary vane pump of claim 1, wherein said oscillating stator is made of a non-metallic material.

* * * * *